US010105925B2

(12) United States Patent
Tan

(10) Patent No.: US 10,105,925 B2
(45) Date of Patent: Oct. 23, 2018

(54) SELF OPENING BAG PACK, APPARATUS AND METHOD OF MAKING SAME

(71) Applicant: Gregorio Lim Tan, Harahan, LA (US)

(72) Inventor: Gregorio Lim Tan, Harahan, LA (US)

( * ) Notice: Subject to any disclaimer, the term of this patent is extended or adjusted under 35 U.S.C. 154(b) by 771 days.

(21) Appl. No.: 14/542,915

(22) Filed: Nov. 17, 2014

(65) Prior Publication Data

US 2015/0072849 A1 Mar. 12, 2015
US 2018/0099469 A9 Apr. 12, 2018

Related U.S. Application Data

(60) Division of application No. 13/167,675, filed on Jun. 23, 2011, now Pat. No. 8,915,372, which is a (Continued)

(51) Int. Cl.

| | |
|---|---|
| ***B31B 1/08*** | (2006.01) |
| ***B31B 70/14*** | (2017.01) |
| ***B65D 33/00*** | (2006.01) |
| *B31B 155/00* | (2017.01) |
| *B31B 160/10* | (2017.01) |

(Continued)

(52) U.S. Cl.

CPC ..... *B31B 70/14* (2017.08); *B65D 33/001* (2013.01); *B65D 33/007* (2013.01); *B31B 70/16* (2017.08); *B31B 70/20* (2017.08); *B31B 70/266* (2017.08); *B31B 70/36* (2017.08); *B31B 70/874* (2017.08); *B31B 70/988* (2017.08); *B31B 2155/00* (2017.08); *B31B 2155/003* (2017.08); *B31B 2160/10* (2017.08)

(58) Field of Classification Search

CPC ..... B31B 2155/00; B31B 2155/003; B31B 70/14; B31B 70/142; B31B 70/148; B31B 70/16; B31B 70/20; B31B 70/36; B31B 70/874; B31B 70/98; B31B 70/986; B31B 70/988; B31B 2160/10; B31B 2160/106; B65D 33/001; B65D 33/007; B65D 33/06; B65D 33/10; B65D 33/105; B65D 33/14

USPC ..... 206/554; 493/194, 195, 199, 203, 204, 493/227, 342, 373; 383/9, 10, 37, 105, 383/120, 903

See application file for complete search history.

(56) References Cited

U.S. PATENT DOCUMENTS

| | | | |
|---|---|---|---|
| 3,196,728 | A | 7/1965 | Snow |
| 3,368,441 | A | 2/1968 | Piazze |

(Continued)

*Primary Examiner* — Hemant M Desai
*Assistant Examiner* — Valentin Neacsu
(74) *Attorney, Agent, or Firm* — David A. Belasco; Belasco Jacobs & Townsley, LLP

(57) ABSTRACT

An apparatus for making a self-opening bag pack includes a supply of film material. An extruder forms a continuous tube of film. A flattener flattens the tube. A corona treater treats at least one surface of the flattened tube. A first sealer forms a bottom seam across a width of the flattened tube. A cutter cuts the flattened tube into bag blanks at a predetermined distance from the bottom seam. A stacker forms the bag blanks into a bag pack. An adhesion knife penetrates the bag pack and adheres adjacent bag blanks together in the bag pack. An aperture maker forms means for suspending the bag pack from a dispensing rack. The pack is attached to the dispensing rack and the front wall of the subsequent bag will be adhered to the rear wall of a first bag, thereby causing the first bag to open when pulled from the rack.

30 Claims, 11 Drawing Sheets

Related U.S. Application Data continuation-in-part of application No. 11/502,719, filed on Aug. 11, 2006.

(51) Int. Cl.

| | |
|---|---|
| *B31B 70/86* | (2017.01) |
| *B31B 70/20* | (2017.01) |
| *B31B 70/16* | (2017.01) |
| *B31B 70/26* | (2017.01) |
| *B31B 70/36* | (2017.01) |
| *B31B 70/98* | (2017.01) |

(56) References Cited

U.S. PATENT DOCUMENTS 4,261,780 A * 4/1981 Yanai ..... B26F 3/06 156/251
4,636,191 A 1/1987 Piggott
5,269,605 A 12/1993 Nguyen
5,307,935 A 5/1994 Kemanjian
5,335,788 A * 8/1994 Beasley ..... B65D 33/001 206/554
5,346,310 A 9/1994 Nguyen
5,363,965 A 11/1994 Nguyen
5,469,969 A 11/1995 Huang
5,507,713 A * 4/1996 Glod, Sr. ..... B29C 59/10 206/554
5,562,580 A * 10/1996 Beasley ..... B65D 33/001 206/554
5,695,064 A * 12/1997 Huang ..... A47F 13/085 206/554
5,863,130 A * 1/1999 Nguyen ..... B65B 43/14 206/554
5,865,313 A * 2/1999 Huang ..... B65D 33/001 206/554
5,881,882 A 3/1999 Fletcher
5,938,033 A 8/1999 Huang
5,967,662 A * 10/1999 Chew ..... B65D 33/001 206/554
5,967,962 A * 10/1999 Huang ..... B26D 7/1863 493/199
6,105,780 A * 8/2000 Nguyen ..... B65D 33/001 206/554
6,171,226 B1 * 1/2001 DeMatteis ..... B29C 65/004 493/226
6,186,933 B1 2/2001 DeMatteis
6,269,950 B1 8/2001 Nguyen
6,325,214 B1 12/2001 Smithson
6,435,350 B1 8/2002 Huang
6,446,810 B1 9/2002 Huang
6,585,197 B1 * 7/2003 Daniels ..... A47F 9/042 206/554
6,716,296 B2 * 4/2004 Chum ..... B65D 33/001 156/290
2001/0029724 A1 * 10/2001 DeMatteis ..... B65B 43/14 53/459
2002/0074260 A1 6/2002 Huang
2002/0108882 A1 * 8/2002 DeMatteis ..... A47F 9/042 206/554
2004/0074364 A1 4/2004 Prudhomme
2005/0041890 A1 * 2/2005 Tan ..... B65D 33/001 383/37
2005/0087542 A1 * 4/2005 Bazbaz ..... A47F 9/042 221/33
2005/0139508 A1 * 6/2005 Su ..... B65D 31/10 206/554
2005/0276669 A1 12/2005 Pottorff
2006/0045393 A1 * 3/2006 Daniels ..... B65D 33/004 383/120
2008/0035522 A1 * 2/2008 Tan ..... B65D 33/001 206/554
2010/0167893 A1 * 7/2010 Wilkerson ..... B31B 19/00 493/227
2012/0160732 A1 * 6/2012 Tan ..... B65D 33/001 206/554

* cited by examiner

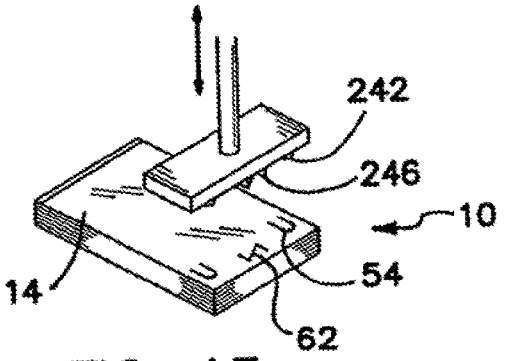
FIG. 13
FIG. 14
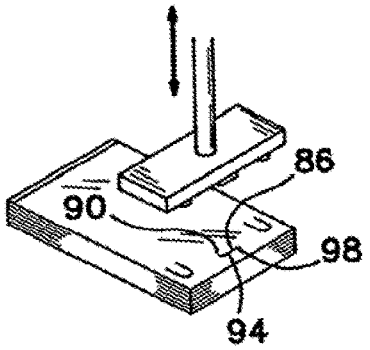
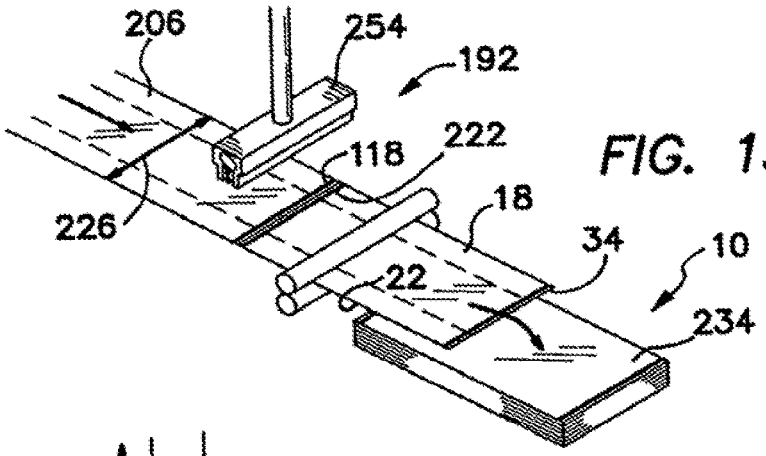
FIG. 15
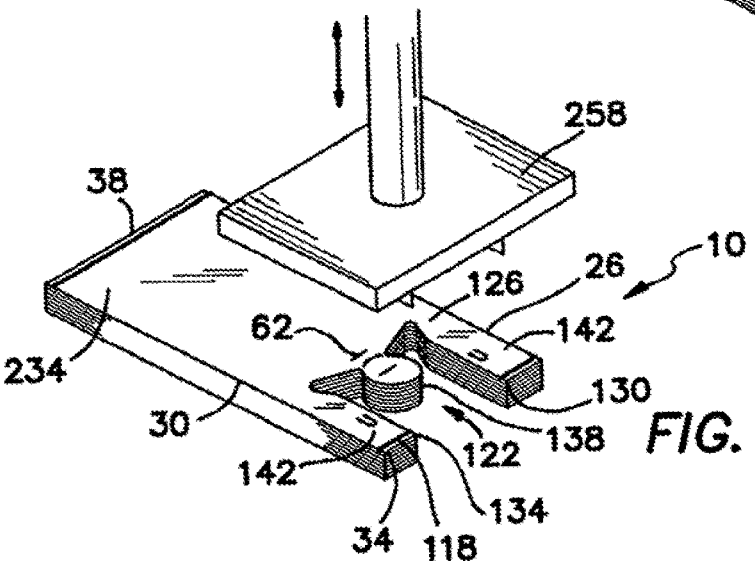
FIG. 16

SELF OPENING BAG PACK, APPARATUS AND METHOD OF MAKING SAME

RELATED APPLICATION

This application is Divisional of U.S. application Ser. No. 13/167,675, filed Jun. 23, 2011 which is a Continuation-in-Part of U.S. application Ser. No. 11/502,719, filed Aug. 11, 2006, now abandoned, which are incorporated herein by reference in their entirety.

FIELD OF INVENTION

The invention pertains to film bags typically used for groceries, produce or other merchandise. More particularly, the invention relates to film bags for use with dispensing racks that are designed to open as bags are pulled from the dispenser.

BACKGROUND OF THE INVENTION

Film bags are commonly used in supermarkets, department stores and similar applications. These bags have advantages in that they are relatively inexpensive to produce, provide substantial carrying capacity and may include easily used handles. In order to make these bags easier to handle and easier to fill, they are usually used in combination with a dispensing rack or hook. Dispensing racks typically include a pair of horizontally oriented arms from which the bags are suspended by means of holes in upper portions of the bags. If the bags can be made to open as they are pulled from the dispensing rack or hook, they become substantially easier to use. Various techniques have been developed for causing film bags to open as they are removed from dispensing racks or hooks.

U.S. Patent Application No. 2005/0087542, issued to Bazbaz is directed to a tabless, self-opening T-shirt-styled film bag is provided having a handle, stress relief notch, and mounting tab structure for providing a wide-opening bag mouth and a bag having high weight carrying capacity. Handles have a narrow upper portion, a wide middle portion and a narrow lower portion. Handle mounting apertures are provided in the wide middle portion, which projects inwardly above the mouth of the bag. The handle mounting apertures are formed by a blade having an elongate section that is bent to form an obtuse angle.

The handle mounting aperture has a sufficient width for accommodating arms of a dispensing rack and a height about three times as great as the width. The bag has a central mounting tab extending above the mouth of the bag and between the handles. A stress relief notch having a reasonably tight radius of curvature is provided between each handle and the mounting tab. The mounting tab has a mounting aperture formed by two blades meeting at a sharp corner, the corner having essentially no radius of curvature. A severable region is provided between the corner and an outer edge of the mounting tab, which can tear as the bag is removed from a mounting hook on a dispensing rack. Multiple bags are aligned and bonded together to provide a unitary pack, where pulling one bag off a dispensing rack pulls an adjacent bag open.

U.S. Pat. No. 4,676,378 issued to Baxley et al., discloses a bag pack comprising a stack of film shopping bags that are bound together and mounted on a rack in such a manner that as one is removed from the rack, the next is opened and remains on the rack to receive material therein.

The rack that is used in this invention for the bag pack comprises a flat base with a pair of laterally spaced support arms to accommodate fully expanded bags with handles engaged with the support arms. A transverse member extends between the support arms to support a tab receiving hook element for engagement through the tab apertures. When the bag pack is produced, and either prior to or simultaneously with the forming of a cut line through the stacked bag handles, the flaps are bonded together throughout the full stack. This is done by use of a heated pin or rod extended centrally through the flaps to directly heat seal the flaps together.

U.S. Pat. No. 6,105,780, issued to Nguyen describes a bag and dispensing system wherein the thermoplastic bag to be dispensed may be retained in an open position, to allow for the loading thereof with contents for carrying, such as purchased goods or the like. The system is further configured such that the loaded bag, when dispensed, draws the next bag in the stack forward into an open loading position such that it is ready to be loaded with goods without further manipulation by the attendant. The preferred embodiment of the present invention teaches the utilization multi-edged punch applied to the handle area of the bags to hold said handles together for handling of the bag pack, and for facilitating opening of the next bag in the stack on the rack, when a loaded bag is removed.

The preferred embodiment of the present invention utilizes co-extruded film, wherein there is provided a high density film having bonded thereto a lower density film of lesser density than said high density film, such that said lower density film forms the exterior side of said co-extruded film. The co-extruded film is then corona treated at a higher energy level than that recommended for facilitating a printing surface on said film. The film is then die-cut to form bag packs, and simultaneously punched with the multi-faceted punch in the area of the handles. This punch impacts the film forming the bag walls, melding the adjacent walls together in a releasable fashion, allowing self opening of said bags.

U.S. Pat. No. 5,207,328, issued to Huang et al. is directed to a pack of self-opening bags with a front, rear, and co-joined side walls, with front and rear tabs extending from top edges of the front and rear walls. The tabs have a curved aperture slits therein, and the tabs are frangibly adhered together with contact adhesive. The slit has a main cut section, a first curved end section at one end, and a second curved end section at the opposite end. The first curved section has a curve that extends upwardly and inwardly from the main cut section. The second curved section has a substantially semi-circular curve that extends from the main cut section in a direction towards the bottom edge of the tab and has an end that is substantially perpendicular to and adjacent the main cut section. In one embodiment, the first curved section is dashed.

U.S. Patent Application No. 2002/0108882 issued to DeMatteis is directed to a tab for mounting a bag bundle on a retaining hook of the type having an upwardly bent hook is shown configured in a bundle of bags. The bundle of bags has at least a leading bag and a plurality of trailing bags. There is at least one tab attached to one bag wall of each bag. This tab is in alignment with like tabs from like bag walls. The tab includes a flanged aperture including at least one peak, with this peak protruding inwardly toward and to the aperture for contact with the upwardly bent hook whereby the tabs are bent out of alignment with the upwardly shaped hook.

U.S. Pat. No. 4,636,191 issued to Piggott discloses a bag making machine for producing bags from an elongate strip of plastic web material. The disclosure relates to various improvements in the bag making machine such as the apparatus for cutting the bag handle aperture. The apparatus includes at least one circular cutting blade having a plunger movable relative thereto within its cutting periphery. The plunger includes a web piercing member on its leading face which member positively holds the web material relative to the cutting blade and plunger.

U.S. Patent Application No. 2004/0074364, issued to Prudhomme describes a multiple variable punch assembly is configurable for punching holes and slits in a plastic film material. The assembly has frame is positioned below the plane of film with one or more transverse carriages positioned to slide on the sides of the frame. Each of the carriages has side plate members, and upper and lower rails extending across the frame in the transverse direction. The upper rail is positioned above the plane of the film and the lower rail is positioned directly below the upper rail and below the film web plane. The positions of the carriages can be adjusted along the frame in the machine direction. The punch head assemblies are adjustably mounted the carriages, with an upper plate fitted onto the upper carriage rail and a lower backing plate situated beneath it on the lower carriage rail. An alignment pin can be inserted into aligned holes for positioning the upper plate and the lower backing plate. An auxiliary carriage can be mounted on one of the main carriages, and provides a pair of auxiliary rails for mounting an additional punch head.

While other variations exist, the above-described designs for self-opening bag packs are typical of those encountered in the prior art. It is an objective of the present invention to provide for a film bag pack that is suitable for use with standardized dispensing racks and includes a self-opening feature. It is a further objective to provide this capability in a bag pack that includes bags that are durable, break-resistant and easily produced. It is a still further objective of the invention to provide the above-described bag packs without the need for localized compressed areas in the bag pack. Finally, it is an objective of the invention to provide bags that open with uniform force from the first bags of the pack to the last.

While some of the objectives of the present invention are disclosed in the prior art, none of the inventions found include all of the requirements identified.

SUMMARY OF THE INVENTION

The present invention addresses all of the deficiencies of prior art self-opening bag pack inventions and satisfies all of the objectives described above.

(1) A self-opening bag pack providing the desired features may be constructed from the following components. A plurality of stacked film bags is provided. Each of the bags has front and rear walls, each of the front and rear walls has first and second side edges, a top edge and a bottom edge. The front and rear walls are integrally joined at their first and second side edges and secured together at their bottom edges and define an open mouth portion adjacent the top edges. At least an upper portion of an outer surface of the front and rear walls of each of the bags has been corona treated. Means are provided for attaching the bag pack to a dispensing rack. Front and rear walls of each of the bags in the bag pack are penetrated by at least one knife cut. The knife cut has first and second ends and first and second edges. Film material adjacent the knife cut adheres the rear wall of a first bag to the front wall of a subsequent bag in the bag pack. When the bag pack is attached to the dispensing rack and the first bag is pulled outwardly from the bag pack, the front wall of the subsequent bag will be adhered to the rear wall of the first bag, thereby causing the first bag to open.

(2) In a variant of the invention, the film comprises less than 49 wt. % high density, high molecular weight polyethylene.

(3) In another variant, the corona treatment on the outer surfaces of the front and rear walls of each of the bags is an amount sufficient to result in a surface tension on the corona treated surface of 35-39 dynes/cm.

(4) In still another variant, the first and second edges of the knife cut are spaced apart by a distance ranging from 0.02 inches to 0.3 inches.

(5) In yet another variant, the knife cut is orthogonal to the first and second side edges and centrally located below the mouth portion.

(6) In a further variant, the knife cut is S-shaped.

(7) In still a further variant, the knife cut is Z-shaped.

(8) In yet a further variant, the knife cut is in the form of a straight line, the straight line has at least one curved section at either of first and second ends of the straight line.

(9) In a variant of the invention, each of the bags includes longitudinally oriented side gussets.

(10) In another variant, the means for attaching the bag pack to a dispensing rack includes first and second openings. The first and second openings penetrate and extend transversely through the bag pack in an upper portion of the bags. The openings are spaced downwardly from the top edge, spaced inwardly from the first and second side edges and serve to support the bag pack on horizontal arms of a dispensing rack.

(11) In still another variant, each of the bags of the bag pack includes an upper seam. The upper seam seals the front wall to the rear wall at their respective top edges. A U-shaped cut-out is provided. The U-shaped cut-out is located in an upper portion of the bag and commences at a first point along the upper seam spaced inwardly from the first side edge and extends to a second point along the upper seam spaced inwardly from the second side edge. The cut-out extends downwardly toward the bottom edges, thereby forming an open mouth portion and a pair of bag handles.

(12) In yet another variant, at least one cold staking area pierces and extends transversely through the bag pack for maintaining the bags in the bag pack in substantial registration.

(13) In a further variant, at least one hot melt pin area pierces and extends transversely through the bag pack for maintaining the bags in the bag pack in substantial registration.

(14) In still a further variant, the means for attaching the bag pack to a dispensing rack includes first and second openings. The first and second openings penetrate and extend transversely through the bag pack in an upper portion of the bag handles. The openings are spaced downwardly from the upper seam and serve to support the bag pack on horizontal arms of a dispensing rack.

(15) In yet a further variant, a central tab portion is connected to the open mouth portion of the bags in the bag pack. An aperture is provided. The aperture extends transversely through the bag pack within the central tab portion for suspending the bag pack from a dispensing member.

(16) In a variant of the invention, the central tab portion is located above an upper edge of the open mouth portion and attached to it, thereby providing stress relief for the open mouth portion.

(17) In another variant, the central tab portion of each bag in the bag pack is detachably connected to the open mouth portion of the bags.

(18) In still another variant, the central tab portion of each bag in the bag pack includes a frangible section. The frangible section extends between the aperture and an outer edge of the central tab portion. The frangible section ruptures upon removal of the bag from the dispensing member.

(19) In yet another variant, the at least one knife cut is located below the central tab portion.

(20) In a further variant, the at least one knife cut is located within the central tab portion.

(21) In still a further variant, the at least one knife cut is located within the bag handle.

(22) In yet a further variant, the self-opening bag pack includes 0.5 wt. % slip and antiblock compound.

(23) In a variant of the invention, the self-opening bag pack includes 1-3 wt. % calcium carbonate.

(24) In another variant, the self-opening bag pack includes 10-20 wt. % recycled material, the recycled material includes about 40-49 wt. % high density, high molecular weight polyethylene, 12-20 wt. % high density, medium molecular weight polyethylene, 20-30 wt. % linear low density polyethylene, 0-8 wt. % color concentrate.

(25) In still another variant, 10-15 wt. % of the linear low density polyethylene has a density ranging from 0.923-0.924 gm/cc.

(26) In yet another variant, 10-15 wt. % of the linear low density polyethylene has a melt index ranging from 0.25-0.30 gm/10 minutes.

(27) In a further variant, the high density, medium molecular weight polyethylene has a density ranging from 0.937-0.947 gm/cc.

(28) In still a further variant, the high density, medium molecular weight polyethylene has a melt index ranging from 0.10-0.30 gm/10 minutes.

(29) An apparatus for making a self-opening bag pack includes a supply of film material. An extruder is provided. The extruder forms a continuous tube of film. A flattener is provided. The flattener forms a continuous flattened tube. A corona treater is provided. The treater corona treats at least one surface of the flattened tube. A first sealer is provided. The first sealer forms a bottom seam across a width of the flattened tube at a predetermined interval. A cutter is provided. The cutter cuts the flattened tube into bag blanks at a predetermined distance from the bottom seam. A stacker is provided. The stacker forms the bag blanks into a bag pack. An aperture maker is provided. The aperture maker penetrates the bag pack and forms means for suspending the bag pack from a dispensing rack. An adhesion knife is provided. The knife penetrates the bag pack and adheres adjacent bag blanks together in the bag pack. When the bag pack is attached to the dispensing rack and a first bag is pulled outwardly from the bag pack, the front wall of the subsequent bag will be adhered to the rear wall of the first bag, thereby causing the first bag to open.

(30) In a variant of the invention, the first and second edges of the knife cut are spaced apart by a distance ranging from 0.02 inches to 0.3 inches.

(31) In another variant, the knife cut is orthogonal to the first and second side edges and centrally located below the mouth portion.

(32) In still another variant, the knife cut is S-shaped.

(33) In yet another variant, the knife cut is Z-shaped.

(34) In a further variant, the knife cut is in the form of a straight line. The straight line has at least one curved section at either of first and second ends of the straight line.

(35) In still a further variant, the apparatus for making a self-opening bag pack includes a gusseter. The gusseter forms first and second longitudinal side gussets perpendicular to the width of the flattened tube.

(36) In yet a further variant, the apparatus for making a self-opening bag pack includes a second sealer. The second sealer forms an upper seam across a width of the flattened tube at a predetermined distance from the bottom seam. The upper seam seals the front wall to the rear wall at their respective top edges. A bag mouth cutter is provided. The bag mouth cutter forms a U-shaped cut-out in the bag blank after stacking in the bag pack. The U-shaped cut-out is located in an upper portion of the bag blank and commences at a first point along the upper seam spaced inwardly from the first side edge and extends to a second point along the upper seam spaced inwardly from the second side edge. The cut-out extends downwardly toward the bottom edges, thereby forming an open mouth portion and a pair of bag handles.

(37) In a variant of the invention, the apparatus for making a self-opening bag pack includes at least one cold staker. The cold staker pierces and extends transversely through the bag pack for maintaining the bags in the bag pack in substantial registration.

(38) In another variant, the apparatus for making a self-opening bag pack includes at least one hot melt pin. The hot melt pin pierces and extends transversely through the bag pack for maintaining the bags in the bag pack in substantial registration.

(39) In still another variant, the apparatus for making a self-opening bag pack includes an aperture maker. The aperture maker forms first and second openings. The first and second openings penetrate and extend transversely through the bag pack in an upper portion of the bag handles. The openings are spaced downwardly from the upper seam and serve to support the bag pack on horizontal arms of a dispensing rack.

(40) In yet another variant, the bag mouth cutter forms a central tab portion connected to the open mouth portion of the bag blanks in the bag pack. An aperture is provided. The aperture extends transversely through the bag pack within the central tab portion for suspending the bag pack from a dispensing member.

(41) In a further variant, the bag mouth cutter forms the central tab portion above an upper edge of the open mouth portion and attached to it, thereby providing stress relief for the open mouth portion.

(42) In still a further variant, the bag mouth cutter forms the central tab portion detachably connected to the open mouth portion of the bags.

(43) In yet a further variant, the bag mouth cutter forms the central tab portion of each bag in the bag pack with a frangible section. The frangible section extends from the aperture to an outer edge of the central tab portion. The frangible section ruptures upon removal of the bag from the dispensing member.

(44) In a variant of the invention, the bag mouth cutter forms the at least one knife cut below the central tab portion.

(45) In another variant, the bag mouth cutter forms the at least one knife cut within the central tab portion.

(46) In still another variant, the bag mouth cutter forms the at least one knife cut within the bag handle.

(47) A method of making a self-opening bag pack includes the following steps. Providing a supply of film material. Extruding a continuous tube of film. Flattening the continuous flattened tube. Corona treating at least one surface of the flattened tube. Forming a bottom seam across a width of the flattened tube at a predetermined interval. Cutting the flattened tube into bag blanks at a predetermined distance from the bottom seam. Stacking the bag blanks into a bag pack. Cutting at least one aperture penetrating the bag pack and forming means for suspending the bag pack from a dispensing rack. Forming a knife cut. The knife cut penetrates the bag pack and adheres adjacent bag blanks together in the bag pack. When the bag pack is attached to the dispensing rack and a first bag is pulled outwardly from the bag pack, the front wall of a subsequent bag will be adhered to the rear wall of the first bag, thereby causing the first bag to open.

(48) In a variant of the invention, the first and second edges of the knife cut are spaced apart by a distance ranging from 0.02 inches to 0.3 inches.

(49) In another variant, the knife cut is orthogonal to the first and second side edges and centrally located below the mouth portion.

(50) In still another variant, the knife cut is S-shaped.

(51) In yet another variant, the knife cut is Z-shaped.

(52) In a further variant, the knife cut is in the form of a straight line. The straight line has at least one curved section at either of first and second ends of the straight line.

(53) In still a further variant, the method of making a self-opening bag pack includes the further step of forming first and second longitudinal side gussets perpendicular to the width of the flattened tube.

(54) In yet a further variant, the method of making a self-opening bag pack includes the further steps of forming an upper seam across a width of the flattened tube at a predetermined distance from the bottom seam. The upper seam seals the front wall to the rear wall at their respective top edges. Forming a U-shaped cut-out in the bag blank after stacking in the bag pack. The U-shaped cut-out is located in an upper portion of the bag blank and commences at a first point along the upper seam spaced inwardly from the first side edge and extends to a second point along the upper seam spaced inwardly from the second side edge. The cut-out extends downwardly toward the bottom edges, thereby forming an open mouth portion and a pair of bag handles.

(55) In a variant of the invention, the method of making a self-opening bag pack includes the further step of cold staking the bag pack for maintaining the bags in the bag pack in substantial registration.

(56) In another variant, the method of making a self-opening bag pack includes the further step of hot pinning the bag pack for maintaining the bags in the bag pack in substantial registration.

(57) In still another variant, the method of making a self-opening bag pack includes the further steps of forming first and second openings. The first and second openings penetrate and extend transversely through the bag pack in an upper portion of the bag handles. The openings are spaced downwardly from the upper seam and serve to support the bag pack on horizontal arms of a dispensing rack.

(58) In yet another variant, the method of making a self-opening bag pack includes the further steps of forming a central tab portion connected to the open mouth portion of the bag blanks in the bag pack. Forming an aperture. The aperture extends transversely through the bag pack within the central tab portion for suspending the bag pack from a dispensing member.

(59) In a further variant, the method of making a self-opening bag pack includes the further step of forming the central tab portion above an upper edge of the open mouth portion attached thereto, thereby providing stress relief for the open mouth portion.

(60) In still a further variant, the method of making a self-opening bag pack includes the further step of forming the central tab portion detachably connected to the open mouth portion of the bags.

(61) In yet a further variant, the method of making a self-opening bag pack includes the further step of forming the central tab portion of each bag in the bag pack with a frangible section. The frangible section extends from the aperture to an outer edge of the central tab portion. The frangible section ruptures upon removal of the bag from the dispensing member.

(62) In a variant of the invention, the method of making a self-opening bag pack includes the further step of forming the at least one knife cut below the central tab portion.

(63) In another variant, method of making a self-opening bag pack includes the further step of forming the at least one knife cut within the central tab portion.

(64) In a final variant, the method of making a self-opening bag pack includes the further step of forming the at least one knife cut within the bag handle.

The present invention is a significant inventive step over other self-opening bag packs. Rather than relying on the melding of bag surfaces together resulting from a blunt-tipped punch applied to the top of a corona-treated bag pack (Nguyen, U.S. Pat. No. 5,363,965), the present invention utilizes a uniform knife cut that passes entirely through the pack. In the Nguyen design, the first few bags in the pack will adhere together with a certain force. As bags are removed from the pack, the adherence of one bag wall to the next will be diminished in proportion to the depth of each bag in the pack. The further the bag is from the top of the pack, the less will be the adherence of each bag to the one below it in the pack. The bags of the present invention are adhered together using an elongated cut through the bag walls of a corona treated bag. In a given bag pack, the cut extends from the first bag in the pack through the last. As it is the cut edges of the bag walls that are adhered together, and as the cuts through each bag in the pack are uniform, the force to separate the first two bags in the pack will be substantially the same as the force to separate the last two bags in the pack.

An appreciation of the other aims and objectives of the present invention and an understanding of it may be achieved by referring to the accompanying drawings and the detailed description of a preferred embodiment.

DESCRIPTION OF THE DRAWINGS

FIG. 13 is a detailed perspective view of an apparatus for making a gusseted self-opening bag pack illustrating an Z-shaped knife cut providing the self-opening feature;

FIG. 14 is a detailed perspective view of an apparatus for making a gusseted self-opening bag pack illustrating a narrow, straight knife cut with curved end providing the self-opening feature;

FIG. 15 is a detailed perspective view of an apparatus for making gusseted self-opening bag blanks with top and bottom seams;

FIG. 16 is a detailed perspective view of an apparatus for making a gusseted self-opening T-shirt style bag pack with a straight knife cut below the central tab providing the self-opening feature;

DESCRIPTION OF THE PREFERRED EMBODIMENT

Figure 1:
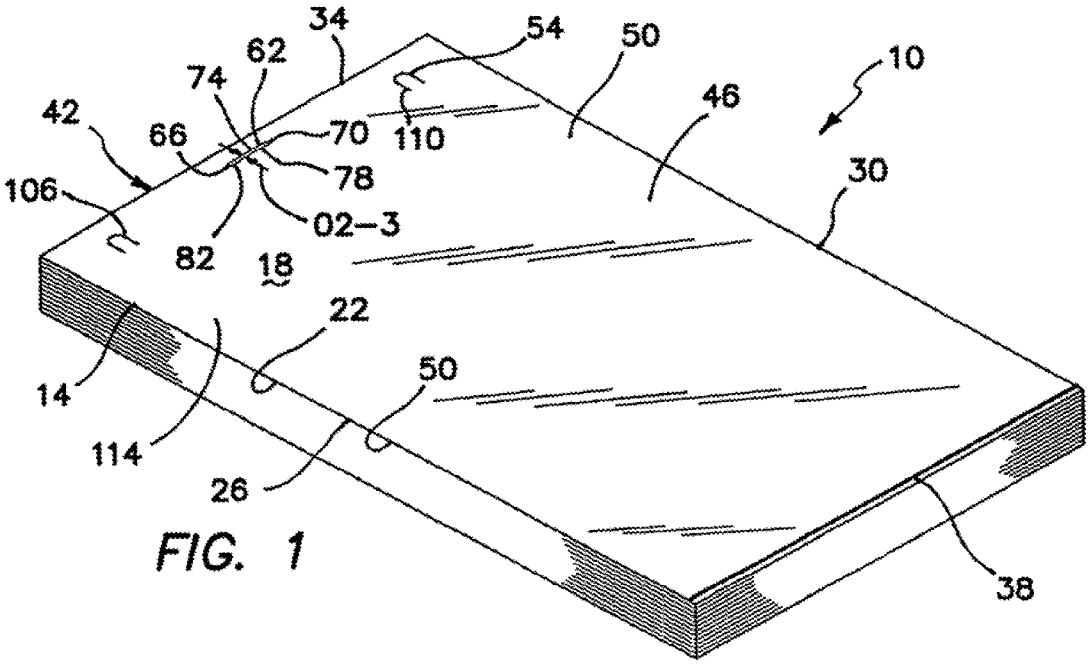
FIG. 1 is a perspective view of a self-opening bag pack illustrating a wide knife cut providing the self-opening feature.

The present invention addresses all of the deficiencies of prior art self-opening bag pack inventions and satisfies all of the objectives described above.

(1) FIGS. 1-10 illustrate a self-opening bag pack 10 providing the desired features that may be constructed from the following components. A plurality of stacked film bags 14 is provided. Each of the bags 14 has front 18 and rear 22 walls, each of the front 18 and rear 22 walls has first 26 and second 30 side edges, a top edge 34 and a bottom edge 38. The front 18 and rear 22 walls are integrally joined at their first 26 and second 30 side edges and secured together at their bottom edges 38 and define an open mouth portion 42 adjacent the top edges 34. At least an upper portion 46 of an outer surface 50 of the front 18 and rear 22 walls of each of the bags 14 has been corona treated. Means 54 are provided for attaching the bag pack 10 to a dispensing rack (not shown). Front 18 and rear 22 walls of each of the bags 14 in the bag pack 10 are penetrated by at least one knife cut 62. The knife cut 62 has first 66 and second 70 ends and first 74 and second 78 edges. Film material 82 adjacent the knife cut 62 adheres the rear wall 22 of a first bag 14 to the front wall 18 of a subsequent bag 14 in the bag pack 10. When the bag pack 10 is attached to the dispensing rack and the first bag 14 is pulled outwardly from the bag pack 10, the front wall 18 of the subsequent bag 14 will be adhered to the rear wall 22 of the first bag 14, thereby causing the first bag 14 to open.

(2) In a variant of the invention, the film 82 comprises less than 49 wt. % high density, high molecular weight polyethylene.

(3) In another variant, the corona treatment on the outer surfaces of the front 18 and rear 22 walls of each of the bags 14 is an amount sufficient to result in a surface tension on the corona treated surface of 35-39 dynes/cm.

(4) In still another variant, the first 74 and second 78 edges of the knife cut 62 are spaced apart by a distance ranging from 0.02 inches to 0.3 inches.

(5) In yet another variant, the knife cut 62 is orthogonal to the first 26 and second 30 side edges and centrally located below the mouth portion 42.

Figure 2:
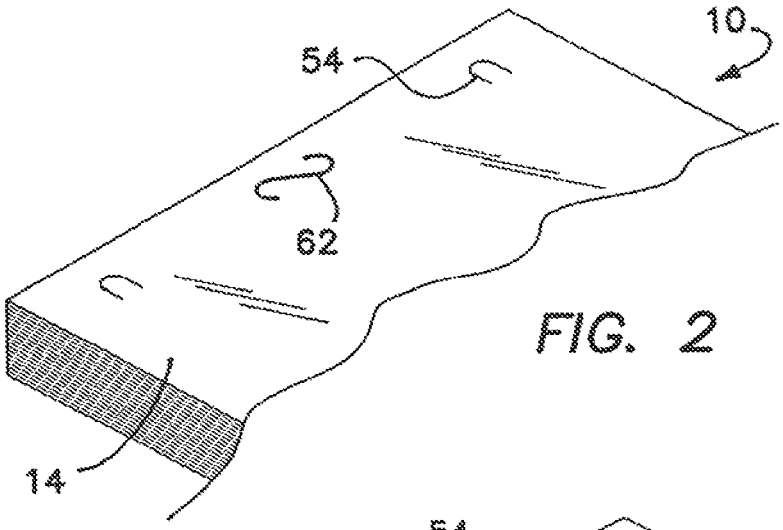
FIG. 2 is a detailed perspective view of a self-opening bag pack illustrating an S-shaped knife cut providing the self-opening feature.

(6) In a further variant, as illustrated in FIG. 2, the knife cut 62 is S-shaped.

Figure 3:
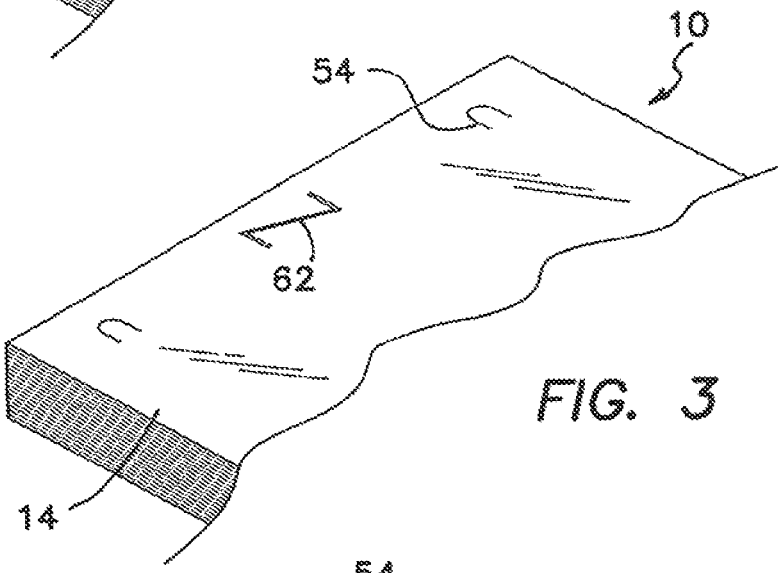
FIG. 3 is a detailed perspective view of a self-opening bag pack illustrating an Z-shaped knife cut providing the self-opening feature.

(7) In still a further variant, as illustrated in FIG. 3, the knife cut 62 is Z-shaped.

Figure 4:
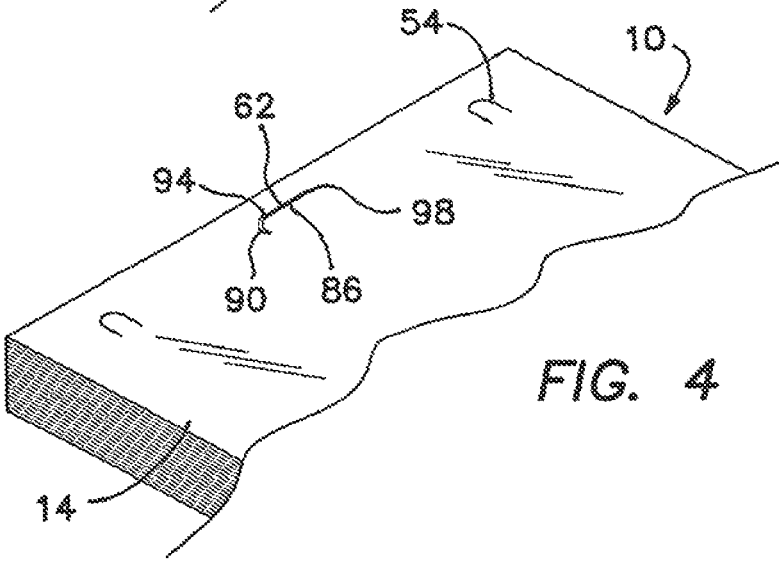
FIG. 4 is a detailed perspective view of a self-opening bag pack illustrating a narrow, straight knife cut with curved end providing the self-opening feature.

(8) In yet a further variant, as illustrated in FIG. 4, the knife cut 62 is in the form of a straight line 86, the straight line 86 has at least one curved section 90 at either of first 94 and second 98 ends of the straight line 86.

Figure 5:
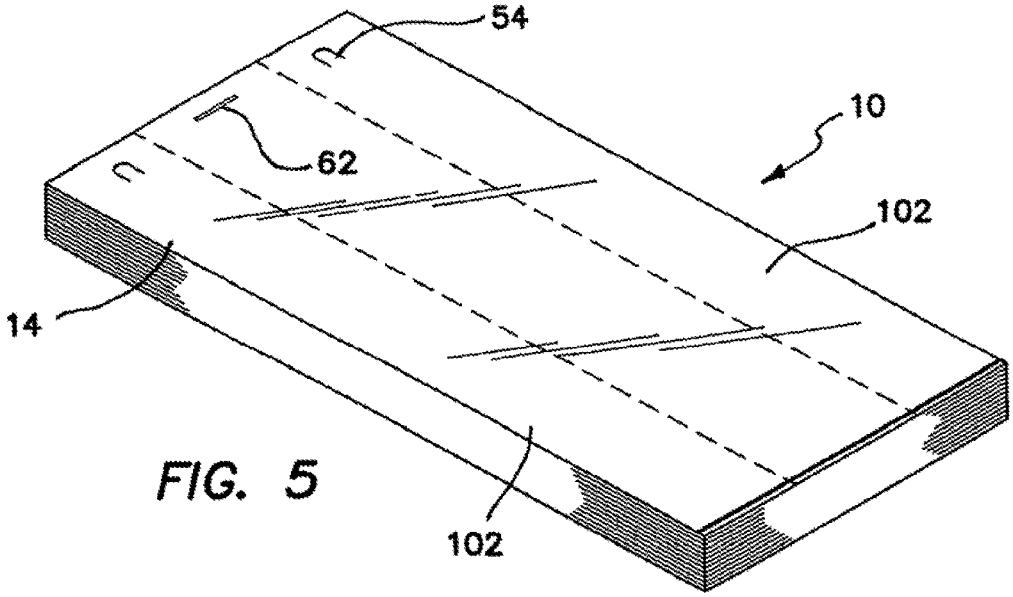
FIG. 5 is a perspective view of a gusseted self-opening bag pack illustrating a wide knife cut providing the self-opening feature.

(9) In a variant of the invention, as illustrated in FIG. 5, each of the bags 14 includes longitudinally oriented side gussets 102.

(10) In another variant, the means 54 for attaching the bag pack 10 to a dispensing rack 58 includes first 106 and second 110 openings. The first 106 and second 110 openings penetrate and extend transversely through the bag pack 10 in an upper portion 114 of the bags 14. The openings 106, 110 are spaced downwardly from the top edge 34, spaced inwardly from the first 26 and 30 second side edges and serve to support the bag pack 10 on horizontal arms (not shown) of a dispensing rack.

Figure 6A:
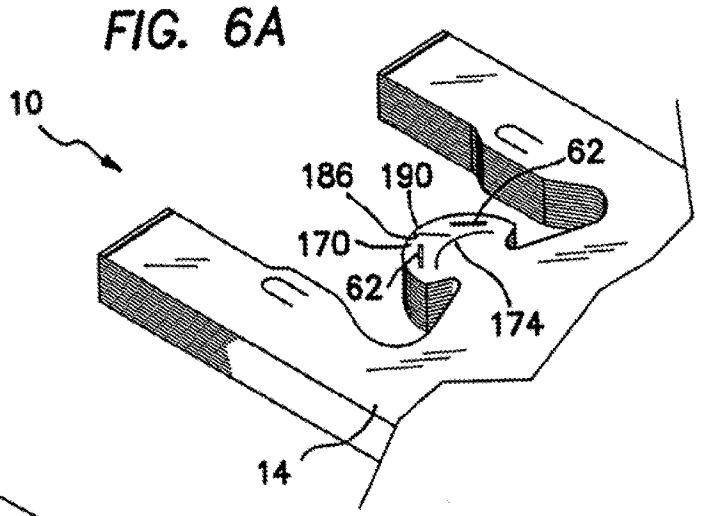
FIG. 6A is a detailed perspective view of a tabless, gusseted self-opening T-shirt style bag pack illustrating narrow knife cuts in the central tab providing the self-opening feature.
Figure 6:
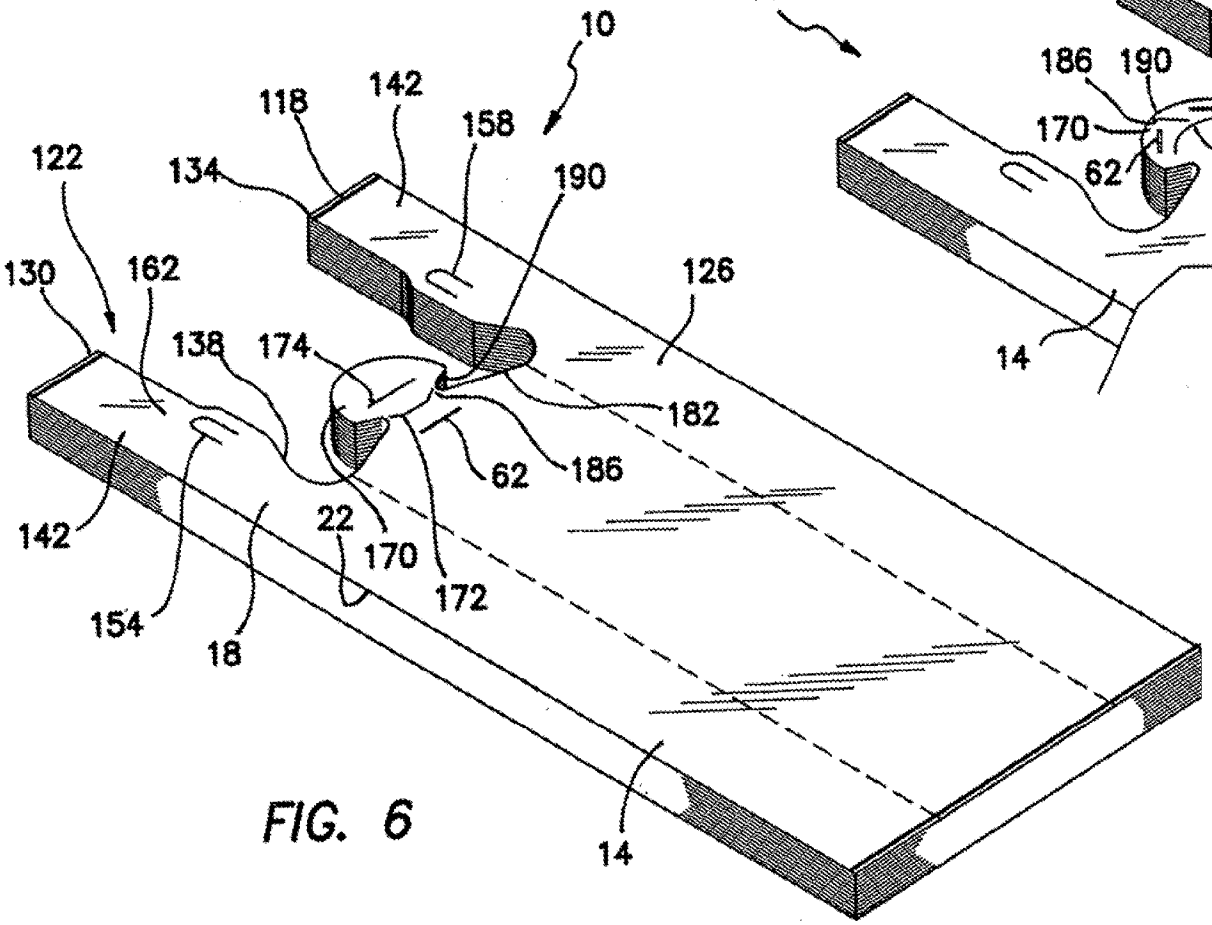
FIG. 6 is a perspective view of a gusseted self-opening T-shirt style bag pack illustrating a narrow knife cut providing the self-opening feature.

(11) In still another variant, as illustrated in FIG. 6, each of the bags 14 of the bag pack 10 includes an upper seam 118. The upper seam 118 seals the front wall 18 to the rear wall 22 at their respective top edges 34. A U-shaped cut-out 122 is provided. The U-shaped cut-out 122 is located in an upper portion 126 of the bag 14 and commences at a first point 130 along the upper seam 118 spaced inwardly from the first side edge 26 and extends to a second point 134 along the upper seam 118 spaced inwardly from the second side edge 30. The cut-out 122 extends downwardly toward the bottom edges 38, thereby forming an open mouth portion 138 and a pair of bag handles 142.

Figure 7:
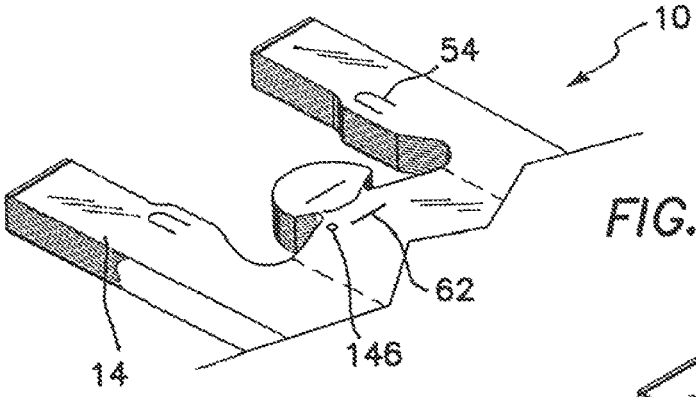
FIG. 7 is a detailed perspective view of a gusseted self-opening T-shirt style bag pack illustrating a knife cut below the central tab providing the self-opening feature and a cold staking spot for bag registration.

(12) In yet another variant, as illustrated in FIG. 7, at least one cold staking area 146 pierces and extends transversely through the bag pack 10 for maintaining the bags 14 in the bag pack 10 in substantial registration.

Figure 8:
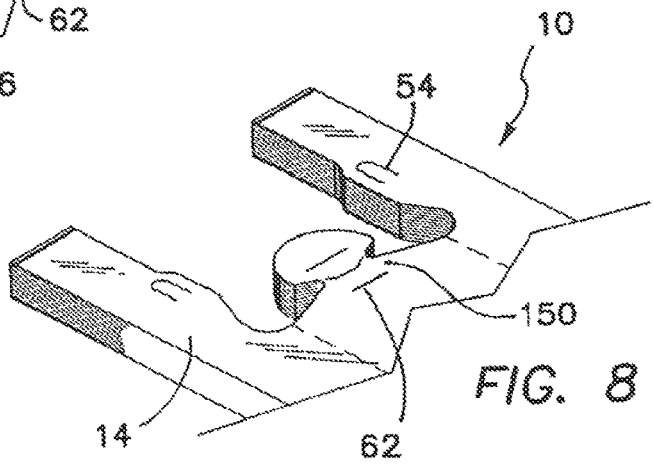
FIG. 8 is a detailed perspective view of a gusseted self-opening T-shirt style bag pack illustrating a knife cut below the central tab providing the self-opening feature and a hot pinning spot for bag registration.

(13) In a further variant, as illustrated in FIG. 8, at least one hot melt pin area 150 pierces and extends transversely through the bag pack 10 for maintaining the bags 14 in the bag pack 10 in substantial registration.

(14) In still a further variant, as illustrated in FIG. 6, the means 54 for attaching the bag pack 10 to a dispensing rack includes first 154 and second 158 openings. The first 154 and second 158 openings penetrate and extend transversely through the bag pack 10 in an upper portion 162 of the bag handles 142. The openings 154, 158 are spaced downwardly from the upper seam 118 and serve to support the bag pack 10 on horizontal arms (not shown) of a dispensing rack.

(15) In yet a further variant, a central tab portion 170 is connected to the open mouth portion 138 of the bags 14 in the bag pack 10. An aperture 174 is provided. The aperture 174 extends transversely through the bag pack 10 within the central tab portion 170 for suspending the bag pack 10 from a dispensing member (not shown).

(16) In a variant of the invention, the central tab portion 170 is located above an upper edge 182 of the open mouth portion 138 and attached to it, thereby providing stress relief for the open mouth portion 138.

(17) In another variant, the central tab portion 170 of each bag 14 in the bag pack 10 is detachably connected to the open mouth portion 138 of the bags 14 at a cut 172.

(18) In still another variant, as illustrated in FIG. 6A, the central tab portion 170 of each bag 14 in the bag pack 10 includes a frangible section 186. The frangible section 186 extends between the aperture 174 and an outer edge 190 of the central tab portion 170. The frangible section 186 ruptures upon removal of the bag 14 from the dispensing member 178.

(19) In yet another variant, the at least one knife cut 62 is located below the central tab portion 170.

Figure 9:
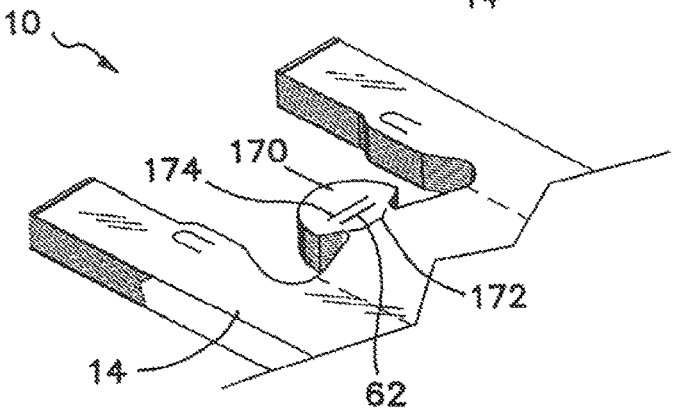
FIG. 9 is a detailed perspective view of a gusseted self-opening T-shirt style bag pack illustrating a knife cut in the central tab providing the self-opening feature.

(20) In a further variant, as illustrated in FIG. 9, the at least one knife cut 62 is located within the central tab portion 170.

Figure 10:
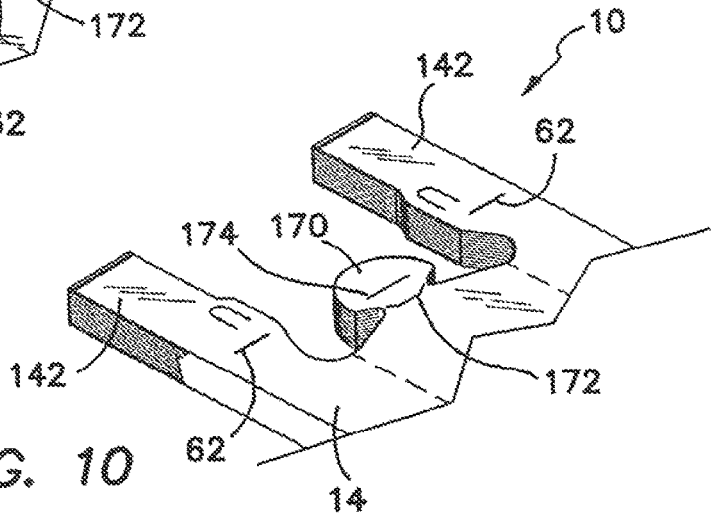
FIG. 10 is a detailed perspective view of a gusseted self-opening T-shirt style bag pack illustrating knife cuts in the bag handles providing the self-opening feature.

(21) In still a further variant, as illustrated in FIG. 10, the at least one knife cut 62 is located within the bag handle 142.

(22) In yet a further variant, the self-opening bag pack 10 includes 0.5 wt. % slip and antiblock compound.

(23) In a variant of the invention, the self-opening bag pack 10 includes 1-3 wt. % calcium carbonate.

(24) In another variant, the self-opening bag pack 10 includes 10-20 wt. % recycled material, the recycled material includes about 40-49 wt. % high density, high molecular weight polyethylene, 12-20 wt. % high density, medium molecular weight polyethylene, 20-30 wt. % linear low density polyethylene, 0-8 wt. % color concentrate.

(25) In still another variant, 10-15 wt. % of the linear low density polyethylene has a density ranging from 0.923-0.924 gm/cc.

(26) In yet another variant, 10-15 wt. % of the linear low density polyethylene has a melt index ranging from 0.25-0.30 gm/10 minutes.

(27) In a further variant, the high density, medium molecular weight polyethylene has a density ranging from 0.937-0.947 gm/cc.

(28) In still a further variant, the high density, medium molecular weight polyethylene has a melt index ranging from 0.10-0.30 gm/10 minutes.

Figure 11:
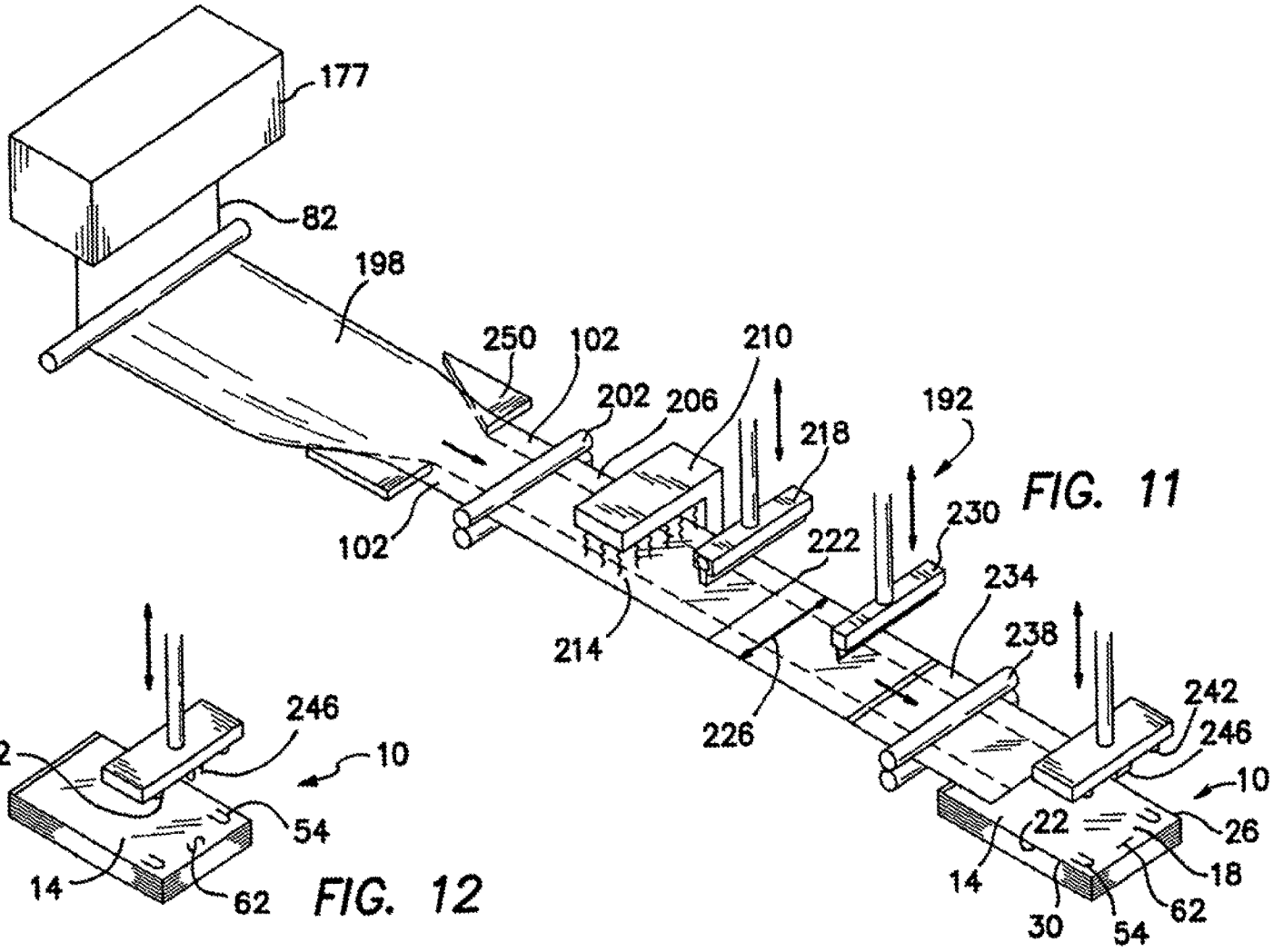
FIG. 11 is a perspective view of an apparatus for making a gusseted self-opening bag stack with a knife cut providing the self-opening feature.

(29) An apparatus 192 for making a self-opening bag pack 10, as illustrated in FIG. 11, includes a supply of film material 82. An extruder 194 is provided. The extruder 194 forms a continuous tube of film 198. A flattener 202 is provided. The flattener 202 forms a continuous flattened tube 206. A corona treater 210 is provided. The treater 210 corona treats at least one surface 214 of the flattened tube 206. A first sealer 218 is provided. The first sealer 218 forms a bottom seam 222 across a width 226 of the flattened tube 206 at a predetermined interval. A cutter 230 is provided. The cutter 230 cuts the flattened tube 206 into bag blanks 234 at a predetermined distance from the bottom seam 222. A stacker 238 is provided. The stacker 238 forms the bag blanks 234 into a bag pack 10. An aperture maker 242 is provided. The aperture maker 242 penetrates the bag pack 10 and forms means 54 for suspending the bag pack 10 from a dispensing rack. An adhesion knife 246 is provided. The knife 246 penetrates the bag pack 10 and adheres adjacent bag blanks 234 together in the bag pack 10. When the bag pack 10 is attached to the dispensing rack and a first bag 14 is pulled outwardly from the bag pack 10, the front wall 18 of the subsequent bag 14 will be adhered to the rear wall 22 of the first bag 14, thereby causing the first bag 14 to open.

(30) In a variant of the invention, the first 74 and second 78 edges of the knife cut 62 are spaced apart by a distance ranging from 0.02 inches to 0.3 inches.

(31) In another variant, the knife cut 62 is orthogonal to the first 26 and second 30 side edges and centrally located below the mouth portion 42.

Figure 12:
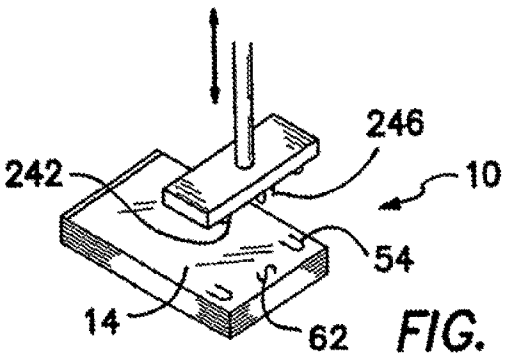
FIG. 12 is a detailed perspective view of an apparatus for making a gusseted self-opening bag pack illustrating an S-shaped knife cut providing the self-opening feature.
Figure 17:
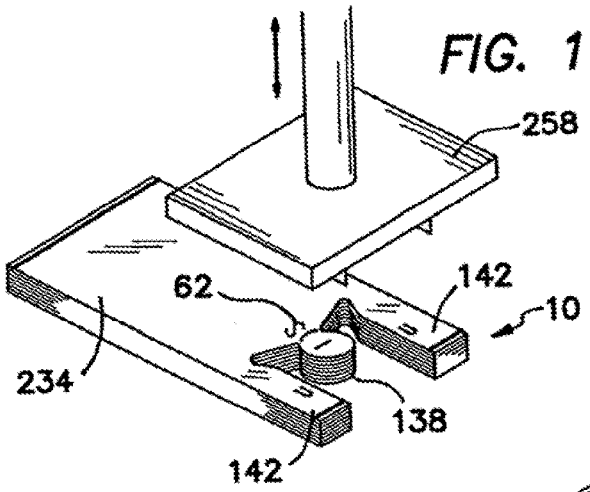
FIG. 17 is a detailed perspective view of an apparatus for making a gusseted self-opening T-shirt style bag pack with an S-shaped knife cut below the central tab providing the self-opening feature.
Figure 18:
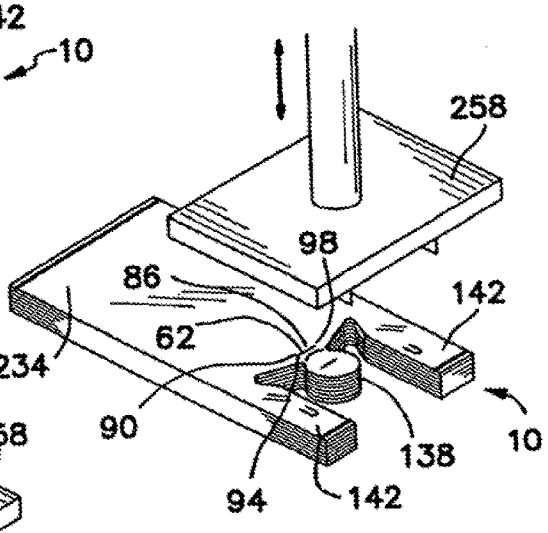
FIG. 18 is a detailed perspective view of an apparatus for making a gusseted self-opening T-shirt style bag pack with a narrow, straight knife cut with curved end below the central tab providing the self-opening feature.
Figure 19:
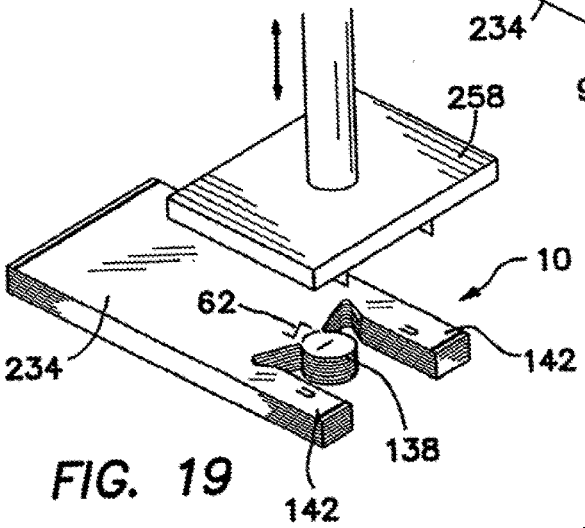
FIG. 19 is a detailed perspective view of an apparatus for making a gusseted self-opening T-shirt style bag pack with an Z-shaped knife cut below the central tab providing the self-opening feature.

(32) In still another variant, as illustrated in FIG. 12, the knife 62 cut is S-shaped.

(33) In yet another variant, as illustrated in FIG. 13, the knife 62 cut is Z-shaped.

(34) In a further variant, as illustrated in FIG. 14, the knife cut 62 is in the form of a straight line 86. The straight line 86 has at least one curved section 90 at either of first 94 and second 98 ends of the straight line 86.

(35) In still a further variant, as illustrated in FIG. 11, the apparatus 192 for making a self-opening bag pack 10 includes a gusseter 250. The gusseter 250 forms first and second longitudinal side gussets 102 perpendicular to the width 226 of the flattened tube 206.

(36) In yet a further variant, as illustrated in FIGS. 15-19, the apparatus 192 for making a self-opening bag pack 10 includes a second sealer 254. The second sealer 254 forms an upper seam 118 across a width 226 of the flattened tube 206 at a predetermined distance from the bottom seam 222. The upper seam 118 seals the front wall 18 to the rear wall 22 at their respective top edges 34. A bag mouth cutter 258 is provided. The bag mouth cutter 258 forms a U-shaped cut-out 122 in the bag blank 234 after stacking in the bag pack 10. The U-shaped cut-out 122 is located in an upper portion 126 of the bag blank 234 and commences at a first point 130 along the upper seam 118 spaced inwardly from the first side edge 26 and extends to a second point 134 along the upper seam 118 spaced inwardly from the second side edge 30. The cut-out 122 extends downwardly toward the bottom edges 38, thereby forming an open mouth portion 138 and a pair of bag handles 142.

Figure 21:
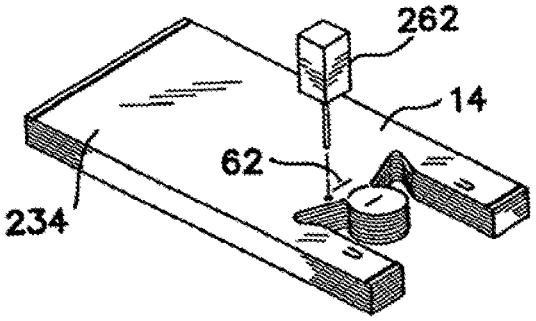
FIG. 21 is a detailed perspective view of an apparatus for making a gusseted self-opening T-shirt style bag pack with a straight knife cut below the central tab providing the self-opening feature with a cold staking device for bag registration.

(37) In a variant of the invention, as illustrated in FIG. 21, the apparatus 192 for making a self-opening bag pack 10 includes at least one cold staker 262. The cold staker 262 pierces and extends transversely through the bag pack 10 for maintaining the bags 14 in the bag pack 10 in substantial registration.

Figure 20:
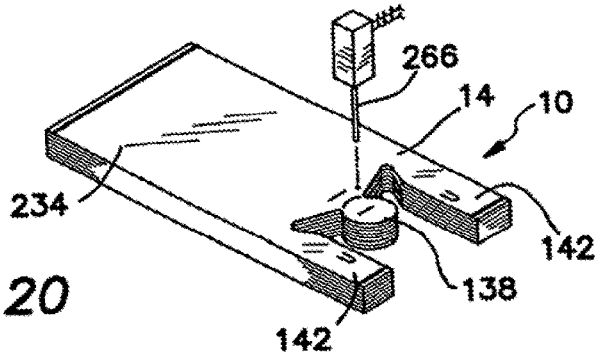
FIG. 20 is a detailed perspective view of an apparatus for making a gusseted self-opening T-shirt style bag pack with a straight knife cut below the central tab providing the self-opening feature with a hot pinning device for bag registration.

(38) In another variant, as illustrated in FIG. 20, the apparatus 192 for making a self-opening bag pack 10 includes at least one hot melt pin 266. The hot melt pin 266 pierces and extends transversely through the bag pack 10 for maintaining the bags 14 in the bag pack 10 in substantial registration.

Figure 22:
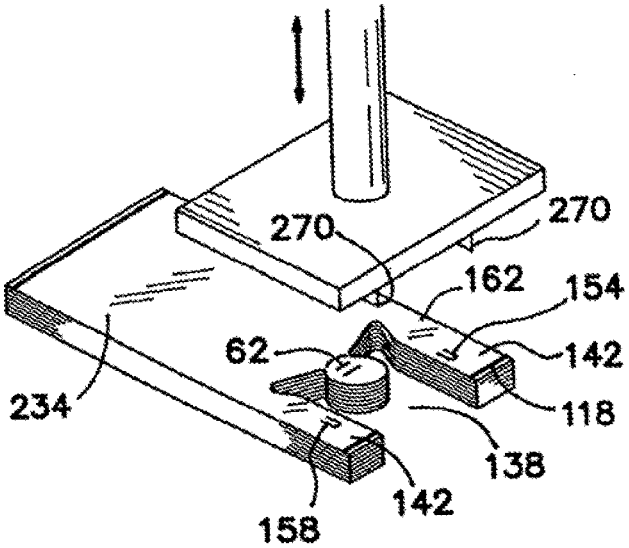
FIG. 22 is a detailed perspective view of an apparatus for making a gusseted self-opening T-shirt style bag pack with a straight knife cut within the central tab providing the self-opening feature.

(39) In still another variant, as illustrated in FIG. 22, the apparatus 192 for making a self-opening bag pack 10 includes an aperture maker 270. The aperture maker 270 forms first 154 and second 158 openings. The first 154 and second 158 openings penetrate and extend transversely through the bag pack 10 in an upper portion 162 of the bag handles 142. The openings 154, 158 are spaced downwardly from the upper seam 118 and serve to support the bag pack 10 on horizontal arms (not shown) of a dispensing rack.

Figure 23:
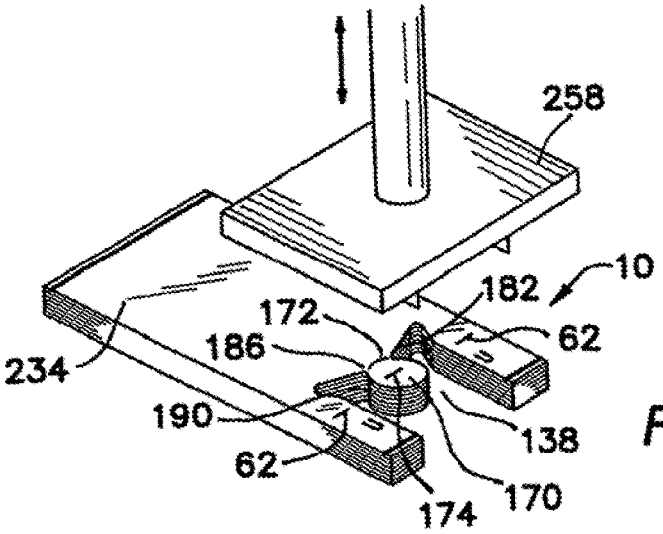
FIG. 23 is a detailed perspective view of an apparatus for making a gusseted self-opening T-shirt style bag pack with straight knife cuts within the bag handles providing the self-opening feature.

(40) In yet another variant, as illustrated in FIG. 23, the bag mouth cutter 258 forms a central tab portion 170 connected to the open mouth portion 138 of the bag blanks 234 in the bag pack 10. An aperture 174 is provided. The aperture 174 extends transversely through the bag pack 10 within the central tab portion 170 for suspending the bag pack 10 from a dispensing member (not shown).

(41) In a further variant, the bag mouth cutter 258 forms the central tab portion 170 above an upper edge 182 of the open mouth portion 138 and attached to it, thereby providing stress relief for the open mouth portion 138.

(42) In still a further variant, the bag mouth cutter 258 forms the central tab portion 170 detachably connected to the open mouth portion 138 of the bags 14 at a cut 172.

(43) In yet a further variant, the bag mouth cutter 258 forms the central tab portion 170 of each bag 14 in the bag pack 10 with a frangible section 186. The frangible section 186 extends from the cut 172 to an outer edge 190 of the central tab portion 170. The frangible section 186 ruptures upon removal of the bag 14 from the dispensing member.

(44) In a variant of the invention, as illustrated in FIG. 21, the bag mouth cutter 258 forms the at least one knife cut 62 below the central tab portion 170.

(45) In another variant, as illustrated in FIG. 22, the bag mouth cutter 258 forms the at least one knife cut 62 within the central tab portion 170.

(46) In still another variant, as illustrated in FIG. 23, the bag mouth cutter 258 forms the at least one knife cut 62 within the bag handle 142.

(47) A method of making a self-opening bag pack 10 includes the following steps. Providing a supply of film material 82. Extruding a continuous tube of film 198. Flattening the continuous flattened tube 198. Corona treating at least one surface of the flattened tube 206. Forming a bottom seam 222 across a width 226 of the flattened tube 206 at a predetermined interval. Cutting the flattened tube 206 into bag blanks 234 at a predetermined distance from the bottom seam 222. Stacking the bag blanks 234 into a bag pack 10. Cutting at least one aperture 174 penetrating the bag pack 10 and forming means 54 for suspending the bag pack 10 from a dispensing rack 58. Forming a knife cut 62. The knife cut 62 penetrates the bag pack 10 and adheres adjacent bag blanks 234 together in the bag pack 10. When the bag pack 10 is attached to the dispensing rack 58 and a first bag 14 is pulled outwardly from the bag pack 10, the front wall 18 of a subsequent bag 14 will be adhered to the rear wall 22 of the first bag 14, thereby causing the first bag 14 to open.

(48) In a variant of the invention, the first 74 and second 78 edges of the knife cut 62 are spaced apart by a distance ranging from 0.02 inches to 0.3 inches.

(49) In another variant, the knife cut 62 is orthogonal to the first 26 and second 30 side edges and centrally located below the mouth portion 42.

(50) In still another variant, the knife 62 cut is S-shaped.

(51) In yet another variant, the knife cut 62 is Z-shaped.

(52) In a further variant, the knife cut 62 is in the form of a straight line 86. The straight line 86 has at least one curved section 90 at either of first 94 and second 98 ends of the straight line 86.

(53) In still a further variant, the method of making a self-opening bag pack includes the further step of forming first and second longitudinal side gussets 102 perpendicular to the width 226 of the flattened tube 206.

(54) In yet a further variant, the method of making a self-opening bag pack 10 includes the following further steps. Forming an upper seam 118 across a width 226 of the flattened tube 206 at a predetermined distance from the bottom seam 222. The upper seam 118 seals the front wall 18 to the rear wall 22 at their respective top edges 34. Forming a U-shaped cut-out 122 in the bag blank 234 after stacking in the bag pack 10. The U-shaped cut-out 122 is located in an upper portion 126 of the bag blank 234 and commences at a first point 130 along the upper seam 118 spaced inwardly from the first side edge 26 and extends to a second point 134 along the upper seam 118 spaced inwardly from the second side edge 30. The cut-out 122 extends downwardly toward the bottom edges 38, thereby forming an open mouth portion 138 and a pair of bag handles 142.

(55) In a variant of the invention, the method of making a self-opening bag pack 10 includes the further step of cold staking the bag pack 10 for maintaining the bags 14 in the bag pack 10 in substantial registration.

(56) In another variant, the method of making a self-opening bag pack 10 includes the further step of hot pinning the bag pack 10 for maintaining the bags 14 in the bag pack 10 in substantial registration.

(57) In still another variant, the method of making a self-opening bag pack includes the further steps of forming first 154 and second 158 openings. The first 154 and second 158 openings penetrate and extend transversely through the bag pack 10 in an upper portion 162 of the bag handles 142. The openings 154, 158 are spaced downwardly from the upper seam 118 and serve to support the bag pack 10 on horizontal arms 166 of a dispensing rack 58.

(58) In yet another variant, the method of making a self-opening bag pack 10 includes the further steps of forming a central tab portion 170 connected to the open mouth portion 138 of the bag blanks 234 in the bag pack 10. Forming an aperture 174. The aperture 174 extends transversely through the bag pack 10 within the central tab portion 170 for suspending the bag pack 10 from a dispensing member 178.

(59) In a further variant, the method of making a self-opening bag pack 10 includes the further step of forming the central tab portion 170 above an upper edge 182 of the open mouth portion 138 attached thereto, thereby providing stress relief for the open mouth portion 138.

(60) In still a further variant, the method of making a self-opening bag pack 10 includes the further step of forming the central tab portion 170 detachably connected to the open mouth portion 138 of the bags 14.

(61) In yet a further variant, the method of making a self-opening bag pack 10 includes the further step of forming the central tab portion 170 of each bag 14 in the bag pack 10 with a frangible section 186. The frangible section 186 extends from the aperture 174 to an outer edge 190 of the central tab portion 170. The frangible section 186 ruptures upon removal of the bag 14 from the dispensing member 178.

(62) In a variant of the invention, the method of making a self-opening bag pack 10 includes the further step of forming the at least one knife cut 62 below the central tab portion 170.

(63) In another variant, method of making a self-opening bag pack 10 includes the further step of forming the at least one knife cut 62 within the central tab portion 170.

(64) In a final variant, the method of making a self-opening bag pack 10 includes the further step of forming the at least one knife cut 62 within the bag handle 142.

Figure 1A:
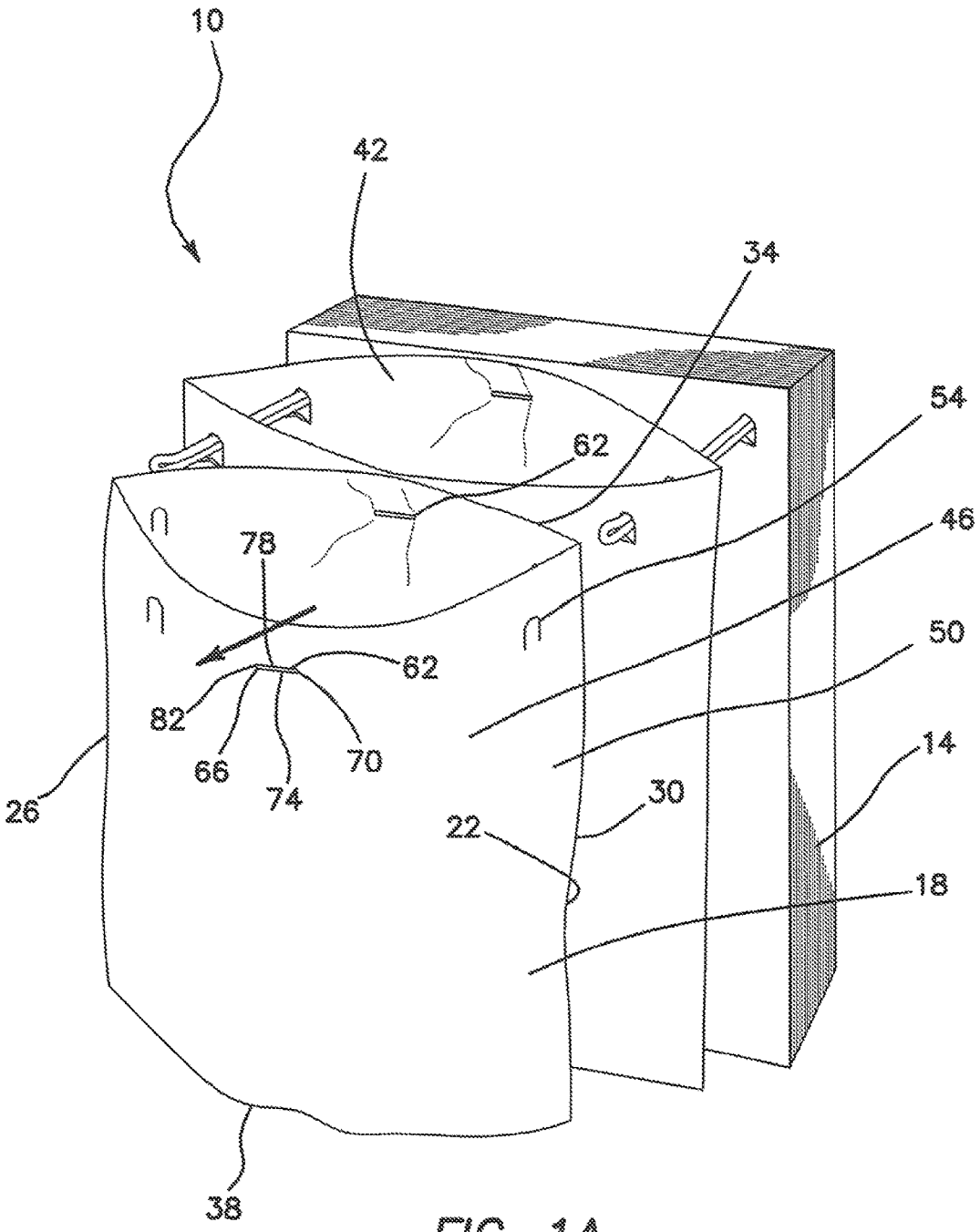
FIG. 1A is a perspective view of the FIG. 1 embodiment disposed upon a dispensing rack and illustrating the self-opening feature implemented through the knife cut penetrating the front and rear walls of the bag.
Figure 1B:
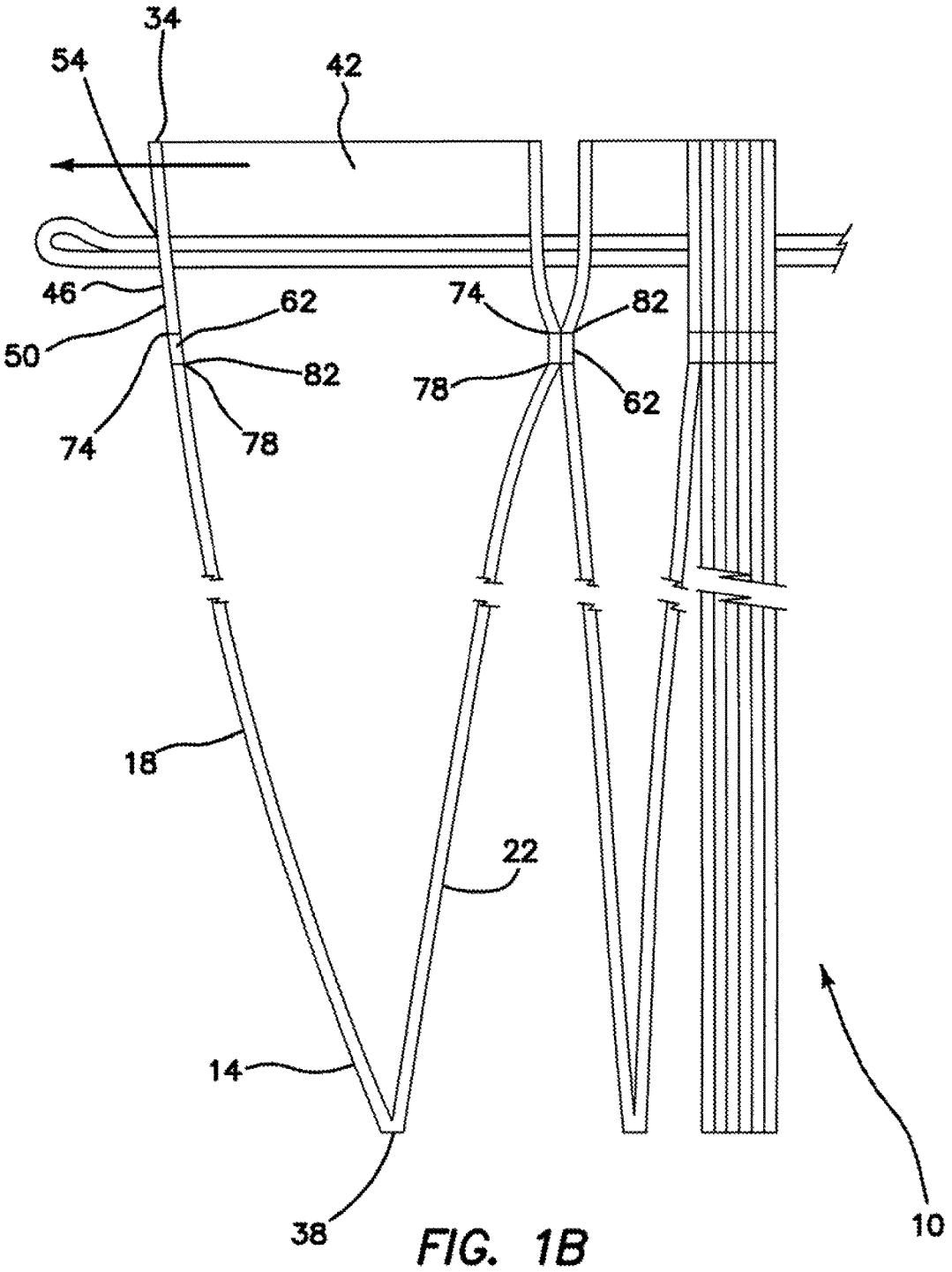
FIG. 1B is a side cross-sectional view of the FIG. 1 embodiment disposed upon a dispensing rack and illustrating the attachment of a first bag to a subsequent bag at the knife cuts penetrating the front and rear walls of the bag.

The present invention is a significant inventive step over other self-opening bag packs. Rather than relying on the melding of bag surfaces together resulting from a blunt-tipped punch applied to the top of a corona-treated bag stack (Nguyen, U.S. Pat. No. 5,363,965), the present invention utilizes a uniform knife cut 62 that passes entirely through the bag pack 10. In the Nguyen design, the first few bags in the pack will adhere together with a certain force. As bags are removed from the stack, the adherence of one bag wall to the next will be diminished in proportion to the depth of each bag in the stack. The further the bag is from the top of the pack, the less will be the adherence of each bag to the one below it in the bag pack. The bags 14 of the present invention, as illustrated in FIGS. 1A and 1B, are adhered together using an elongated cut 62 through the bag walls 18, 22 of a corona treated bag 14. In a given bag pack 10, the cut 62 extends from the first bag 14 in the pack 10 through the last. As it is the cut edges 74, 78 of the bag walls 18, 22 that are adhered together, and as the cuts 62 through each bag 14 in the bag pack 10 are uniform, the force to separate the first two bags 14 in the pack 10 will be substantially the same as the force to separate the last two bags 14 in the pack 10.

In order to objectively demonstrate this inventive step and the unexpected result associated with it the Applicant engaged Duncan Darby, Ph. D., Patricia Marconde and Jeffrey Weir of Clemson University, Center for Flexible Packaging (CEFPACK) to test the bags 14 of the present invention and bags of the Nguyen design with regards to the uniformity of force required to remove bags from the bag packs. As the Nguyen bag design has not proven to be a commercial success and is not generally available, the CEFPACK team had to construct bags of the Nguyen design. Fortunately, U.S. Pat. No. 5,363,965 provides detailed drawings of the types of punches used and the locations on the bags to which the punches are applied. The patent further describes the amount of pressure to be applied to the punch when forming the bag pack. The CEFPACK team acquired a punch of the design shown in FIGS. 9A and 9B of the '965 patent, constructed a press apparatus capable of providing 80-90 bar of pressure to the punch and applied the press to bag packs at locations 37", 38", 37' and 38' as per the '965 patent, using bags of the Nguyen design that lacked only the specified punches.

These bag packs were then mounted on a dispensing rack and a clip attached to a center point of an open portion of each bag. The clip was attached to a SATEC T-1000 universal testing machine with a cable type pulling assembly. The force in pounds required to pull the bags from the rack was recorded and graphed. A similar test was conducted using the knife cut bags 14 of the present invention.

Figure 1C:
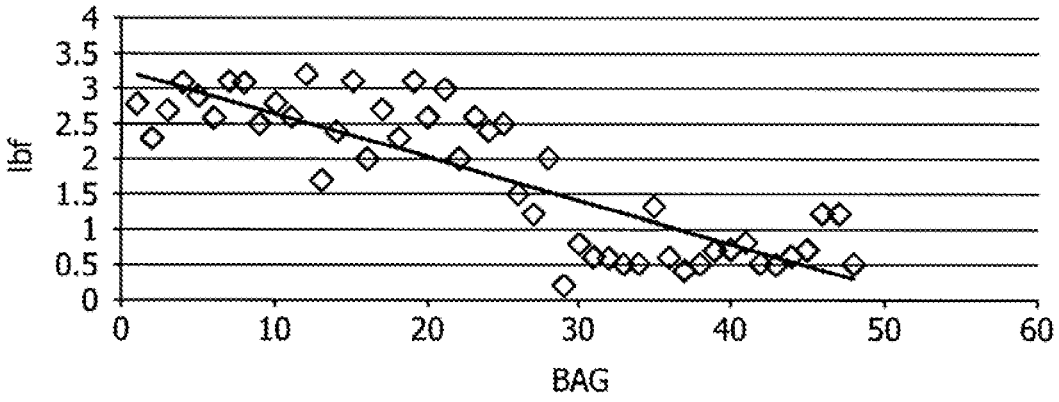
FIG. 1C is a graph illustrating the force applied to a subsequent bag by a leading bag in a bag pack of the Nguyen design.
Figure 1D:
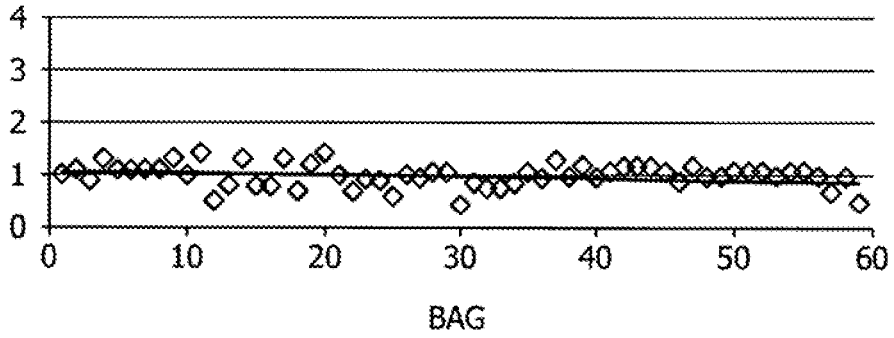
FIG. 1D is a graph illustrating the force applied to a subsequent bag by a leading bag in a bag pack of the design of the present invention.

As shown in FIG. 1C, the force applied by a leading bag to a subsequent bag in the Nguyen design diminishes substantially as the bag pack is depleted. As can also be seen in FIG. 1C, the force required to separate subsequent bags is highly variable. This sometimes results in failures of the subsequent bag to open or in the opening of multiple bags. As can be seen in FIG. 1D, the force applied by a leading bag 14 to a subsequent bag 14 in the present invention stays substantially constant without regard to the position of a bag pair in the bag pack. This allows the bags 14 to be easily and uniformly opened with a lower force but with increased reliability. This ease of use and uniformity of release is the unexpected result that makes the present bag design a significant inventive step.

An appreciation of the other aims and objectives of the present invention and an understanding of it may be achieved by referring to the accompanying drawings and the Detailed Description of a preferred embodiment.

The invention claimed is:

1. An apparatus for making a self-opening bag pack comprising:

a supply of film material;

an extruder, said extruder forming a continuous tube of film;

a flattener, said flattener forming a continuous flattened tube;

a corona treater, said treater corona treating at least one surface of said flattened tube;

a first sealer, said first sealer forming a bottom seam across a width of said flattened tube at a predetermined interval;

a cutter, said cutter cutting said flattened tube into bag blanks at a predetermined distance from said bottom seam;

said bag blanks having front and rear walls, first and second side edges, a top edge, a bottom edge and a mouth portion;

a stacker, said stacker forming said bag blanks into a bag pack an aperture maker, said aperture maker penetrating said bag pack and forming means for suspending said bag pack from a dispensing rack;

an adhesion knife, said knife having a single straight elongated cutting edge and penetrating said bag pack providing a single straight elongated knife cut, said single straight knife cut being parallel to said top edge and having a length less than 25% of a width of said bag blanks, said single straight knife cut extending completely through said front and rear walls of each of said bag blanks in said bag pack, having first and second ends and first and second elongated straight edges, adhering adjacent bag blanks together in said bag pack along both of said first and second elongated straight edges and providing self-opening features;

said first and second elongated straight edges being spaced apart by a predetermined distance; and wherein said bag pack is attached to said dispensing rack and a first bag is pulled outwardly from said bag pack, said first and second elongated straight edges of said knife cut in said front wall of a subsequent bag will be adhered to said first and second elongated straight edges of said knife cut in said rear wall of said first bag, thereby causing said first bag to open.

2. The apparatus for making a self-opening bag pack, as described in claim 1, wherein said first and second elongated straight edges of said knife cut are spaced apart by a distance ranging from 0.02 inches to 0.3 inches.

3. The apparatus for making a self-opening bag pack, as described in claim 1, wherein said single straight elongated knife cut is parallel to a plane of said front and rear walls and is orthogonal to said first and second side edges and centrally disposed between said first and second side edges and spaced from said top edge and spaced by less than 15% of a height of said bag blank toward said bottom edge from said mouth portion.

4. The apparatus for making a self-opening bag pack, as described in claim 1, further comprising a gusseter, said gusseter forming first and second longitudinal side gussets perpendicular to said width of said flattened tube.

5. The apparatus for making a self-opening bag pack, as described in claim 1, further comprising:

a second sealer, said second sealer forming an upper seam across a width of said flattened tube at a predetermined distance from said bottom seam;

said upper seam, sealing said front wall to said rear wall at their respective top edges;

a bag mouth cutter, said bag mouth cutter forming a U-shaped cut-out in said bag blanks after stacking in said bag pack, said U-shaped cut-out being disposed in an upper portion of said bag blanks and commencing at a first point along said upper seam spaced inwardly from said first side edge and extending to a second point along the upper seam spaced inwardly from said second side edge, said cut-out extending downwardly toward said bottom edges, thereby forming an open mouth portion and a pair of bag handles.

6. The apparatus for making a self-opening bag pack, as described in claim 5, further comprising an aperture maker, said aperture maker forming:

first and second openings, said first and second openings penetrating and extending transversely through said bag pack in an upper portion of said bag handles; and said first and second openings being spaced downwardly from said upper seam and serving to support said bag pack on horizontal arms of a dispensing rack.

7. The apparatus for making a self-opening bag pack, as described in claim 5, wherein said bag mouth cutter forms:

a central tab portion connected to said open mouth portion of said bag blanks in said bag pack; and an aperture, said aperture extending transversely through said bag pack within said central tab portion for suspending said bag pack from a dispensing member.

8. The apparatus for making a self-opening bag pack, as described in claim 7, wherein said bag mouth cutter forms said central tab portion above an upper edge of said open mouth portion and attached thereto, thereby providing stress relief for said open mouth portion.

9. The apparatus for making a self-opening bag pack, as described in claim 7, wherein said bag mouth cutter forms said central tab portion detachably connected to said open mouth portion of said bags.

10. The apparatus for making a self-opening bag pack, as described in claim 7, wherein said bag mouth cutter forms:

said central tab portion of each bag in said bag pack with a frangible section;

said frangible section extending from said aperture to an outer edge of said central tab portion; and said frangible section rupturing upon removal of said bag from said dispensing member.

11. The apparatus for making a self-opening bag pack, as described in claim 7, wherein said bag mouth cutter forms said at least one knife cut below said central tab portion.

12. The apparatus for making a self-opening bag pack, as described in claim 7, wherein said bag mouth cutter forms said at least one knife cut within said central tab portion.

13. The apparatus for making a self-opening bag pack, as described in claim 7, wherein said bag mouth cutter forms said at least one knife cut within said bag handle.

14. The apparatus for making a self-opening bag pack, as described in claim 1, further comprising at least one cold staker, said cold staker piercing and extending transversely through said bag pack for maintaining the bags in said bag pack in substantial registration.

15. The apparatus for making a self-opening bag pack, as described in claim 1, further comprising at least one hot melt pin, said hot melt pin piercing and extending transversely through said bag pack for maintaining the bags in said bag pack in substantial registration.

16. A method or making a self-opening bag pack using the apparatus of claim 1, comprising steps of:

providing a supply of film material;

extruding a continuous tube of film using the extruder;

flattening said continuous flattened tube;

corona treating at least one surface of said flattened tube;

forming a bottom seam across a width of said flattened tube at a predetermined interval;

cutting said flattened tube into bag blanks at a predetermined distance from said bottom seam;

stacking said bag blanks into a bag pack;

cutting at least one aperture penetrating said bag pack and forming means for suspending said bag pack from a dispensing rack;

forming a knife cut, said knife cut penetrating said bag pack and adhering adjacent bag blanks together in said bag pack; and whereby, when said bag pack is attached to said dispensing rack and a first bag is pulled outwardly from said bag pack, said front wall of a subsequent bag will be adhered to said rear wall of said first bag, thereby causing said first bag to open.

17. The method of making a self-opening bag pack, as described in claim 16, wherein said first and second edges of said knife cut are spaced apart by a distance ranging from 0.02 inches to 0.3 inches.

18. The method of making a self-opening bag pack, as described in claim 16 wherein said knife cut is orthogonal to said first and second side edges and centrally disposed below said mouth portion.

19. The method of making a self-opening bag pack, as described in claim 16, comprising the further step of forming first and second longitudinal side gussets perpendicular to said width of said flattened tube.

20. The method of making a self-opening bag pack, as described in claim 16, comprising the further steps of:

forming an upper seam across a width of said flattened tube at a predetermined distance from said bottom seam;

said upper seam, sealing said front wall to said rear wall at their respective top edges;

forming a U-shaped cut-out in said bag blank after stacking in said bag pack, said U-shaped cut-out being disposed in an upper portion of said bag blank and commencing at a first point along said upper seam spaced inwardly from said first side edge and extending to a second point along the upper seam spaced inwardly from said second side edge, said cut-out extending downwardly toward said bottom edges, thereby forming an open mouth portion and a pair of bag handles.

21. The method of making a self-opening bag pack, as described in claim 20, comprising the further steps of:

forming first and second openings, said first and second openings penetrating and extending transversely through said bag pack in an upper portion of said bag handles; and said openings being spaced downwardly from said upper seam and serving to support said bag pack on horizontal arms of a dispensing rack.

22. The method of making a self-opening bag pack, as described in claim 20, comprising the further steps of:

forming a central tab portion connected to said open mouth portion of said bag blanks in said bag pack; and forming an aperture, said aperture extending transversely through said bag pack within said central tab portion for suspending said bag pack from a dispensing member.

23. The method of making a self-opening bag pack, as described in claim 22, comprising the further step of forming said central tab portion above an upper edge of said open mouth portion attached thereto, thereby providing stress relief for said open mouth portion.

24. The method of making a self-opening bag pack, as described in claim 22, comprising the further step of forming said central tab portion detachably connected to said open mouth portion of said bags.

25. The method of making a self-opening bag pack, as described in claim 22, comprising the further step of:

forming said central tab portion of each bag in said bag pack with a frangible section;

said frangible section extending from said aperture to an outer edge of said central tab portion; and said frangible section rupturing upon removal of said bag from said dispensing member.

26. The method of making a self-opening bag pack, as described in claim 22, comprising the further step of forming said at least one knife cut below said central tab portion.

27. The method of making a self-opening bag pack, as described in claim 22, comprising the further step of forming said at least one knife cut within said central tab portion.

28. The method of making a self-opening bag pack, as described in claim 22, comprising the further step of forming said at least one knife cut within said bag handle.

29. The method of making a self-opening bag pack, as described in claim 16, comprising the further step of cold staking said bag pack for maintaining the bags in said bag pack in substantial registration.

30. The method of making a self-opening bag pack, as described in claim 16, comprising the further step of hot pinning said bag pack for maintaining the bags in said bag pack in substantial registration.

* * * * *